US010336587B1

(12) United States Patent
Weddel

(10) Patent No.: US 10,336,587 B1
(45) Date of Patent: Jul. 2, 2019

(54) HOIST AND CRANE

(71) Applicant: Lee Weddel, Linden, MI (US)

(72) Inventor: Lee Weddel, Linden, MI (US)

(73) Assignee: Professor Cargo, LLC, Linden, MI (US)

( * ) Notice: Subject to any disclaimer, the term of this patent is extended or adjusted under 35 U.S.C. 154(b) by 0 days.

(21) Appl. No.: 15/838,564

(22) Filed: Dec. 12, 2017

(51) Int. Cl.
*B66C 23/20* (2006.01)
*B66C 9/02* (2006.01)
*B66C 9/08* (2006.01)
*B66C 17/06* (2006.01)

(52) U.S. Cl.
CPC ..... *B66C 23/206* (2013.01); *B66C 9/02* (2013.01); *B66C 9/08* (2013.01); *B66C 17/06* (2013.01)

(58) Field of Classification Search
CPC .. B66C 9/02; B66C 9/08; B66C 17/06; B66C 23/206
See application file for complete search history.

(56) References Cited

U.S. PATENT DOCUMENTS

2006/0086607 A1* 4/2006 Duval ..... B66C 17/06 204/194
2008/0159831 A1* 7/2008 Davis ..... B66C 5/04 414/140.3
2008/0301889 A1* 12/2008 Kang ..... B66C 17/06 14/77.1
2009/0245451 A1* 10/2009 Funkhouser ..... B66C 17/06 376/260
2010/0000955 A1* 1/2010 Nakamitsu ..... B66C 1/10 212/270
2013/0071210 A1* 3/2013 Lanigan, Sr. ..... B66C 17/06 414/281
2013/0139743 A1* 6/2013 Khachaturian ..... B63C 7/04 114/264
2014/0096354 A1* 4/2014 Davi ..... F01D 25/285 29/428
2015/0104273 A1* 4/2015 Van Kuilenburg .. A01K 5/0266 414/21
2015/0151932 A1* 6/2015 Toncelli ..... B66C 17/06 414/788.4
2016/0023867 A1* 1/2016 Posthumus ..... B01F 15/00662 366/150.1
2016/0242361 A1* 8/2016 Liet ..... A01F 25/2027
2016/0272469 A1* 9/2016 Carroll ..... B66C 7/02
2016/0325433 A1* 11/2016 Hashimoto ..... B25J 9/1679
2017/0306609 A1* 10/2017 Peterson ..... E04B 1/24

* cited by examiner

*Primary Examiner* — Saul Rodriguez
*Assistant Examiner* — Ashley K Romano
(74) *Attorney, Agent, or Firm* — L.C. Begin & Associates, PLLC

(57) ABSTRACT

A hoist and crane assembly is presented. The hoist and crane assembly contains an extendable and retractable hoist and crane subassembly that longitudinally moves in and out from the hoist and crane assembly. Further, the hoist and crane subassembly also contains a lateral rail system for moving shipping containers side to side within an associated trailer, for example. Yet further, means for moving shipping containers from the rear to the front of an associated trailer are also contained within the hoist and crane assembly.

7 Claims, 8 Drawing Sheets

FIG - 1
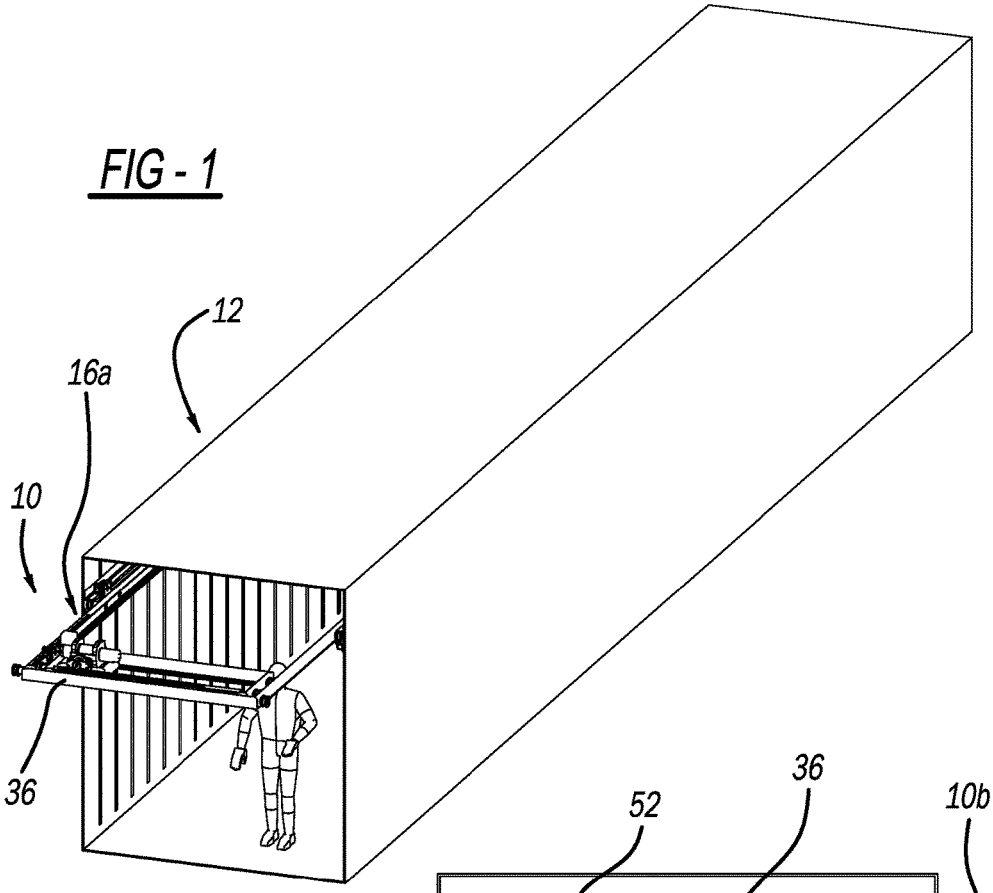
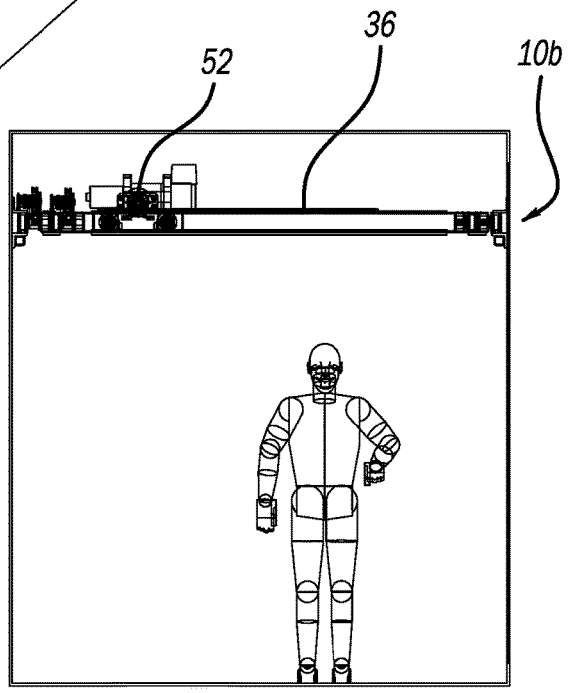
FIG - 2

HOIST AND CRANE

CROSS SECTION TO RELATED APPLICATIONS

Field of the Invention

The present invention generally relates to a system and method for hoisting and moving various crates and packages from the ground to the level of a trailer, such as a trailer used with a semi-truck, portable storage units, or other types of vehicles or storage containers.

Background of the Invention

In the trucking industry, oftentimes, it is required that a trailer for shipping goods be backed up against a loading dock or ramp to provide access to the interior of the trailer. When the ramp or loading dock(s) are congested, or when they are not available, the forklift driver or other loaders are left with moving the shipping containers into the trailer by other means. This oftentimes complicates the loading process if loading of the trailer must be accomplished apart from the loading dock. In particular, lifting the items to be shipped up to the level of the truck trailer becomes a challenge.

Some current lifts are hydraulically powered, and have no block at the front end of the truck. As a result, the hoist as it is being hydraulically directed to the front of the truck may collide with the front end of the truck, resulting in damage. Furthermore, certain lifts have arms that unfold from the rear end of the vehicle, that during use or during movement of the vehicle may cause damage to the trailer or storage assembly, or, may cause damage to outside structures adjacent to the trailer. The current invention obviates these and other concerns.

SUMMARY OF THE INVENTION

In accordance with the present invention, a hoist and crane assembly is presented. The hoist and crane assembly contains an extendable and retractable hoist and crane subassembly that longitudinally moves in and out from the hoist and crane assembly. Further, the hoist and crane subassembly also contains a lateral rail system for moving shipping containers side to side within an associated trailer, for example. Yet further, means for moving shipping containers from the rear to the front of an associated trailer are also contained within the hoist and crane assembly. If desired, a block at the front of the truck may be provided that assures that the hoist and crane assembly does not collide with the interior front of the trailer.

Stated another way, a hoist and crane assembly contains a first rail and a second rail each vertically supported, and each longitudinally extending within said hoist and crane assembly, the second rail oriented substantially parallel to the first rail. In further accordance with the invention, a third rail is slidably engaged to the first rail and a fourth rail is slidably engaged to the second rail, thereby facilitating concurrent longitudinal movement of the third and fourth rails to extend from a rear of the hoist and crane assembly. Yet further, a fifth rail is angularly fixed to the third rail and the fourth rail, and, a sixth rail is angularly fixed to the third rail and the fourth rail, the fifth rail substantially parallel to the sixth rail and the fifth and sixth rails preferably and substantially orthogonally fixed to the third and fourth rails. Yet further, a hoist is operably fixed to the fifth and sixth rails, the hoist movable from the third rail to the fourth rail, and the hoist extendable and retractable from the first and second rails.

If desired, the hoist and crane assembly may also contain a first driver for laterally moving the hoist from the third rail to the fourth rail, wherein the first driver may be a motor or chain that facilitates lateral movement of shipping containers carried by the hoist, for example. Yet further, and if desired, a second driver may be provided for longitudinally moving the hoist longitudinally along the third and fourth rails. Yet further, a third driver may be provided for longitudinally moving the hoist from the rear of an associated trailer toward the front of the trailer, for example.

Yet further, if desired, a first vertical support member and a second vertical support member may be provided wherein the second vertical support member is longitudinally displaced from the first vertical support member, each of the first and second vertical support members fixed to the first rail. In addition, a third vertical support member and a fourth vertical support member may be provided wherein the fourth vertical support member is longitudinally displaced from said the vertical support member, each of the third and fourth vertical support members fixed to the second rail. If desired, a first lateral support member fixed to the first vertical support member and to the third vertical support member is provided, wherein the first lateral support member is substantially orthogonally oriented to the first and second longitudinal members. In addition, a second lateral support member may then be fixed to the second vertical support member and to the fourth vertical support member, wherein the second lateral support member is substantially orthogonally oriented to the second and fourth longitudinal members.

Yet further, if desired, a plurality of height adjustment members may be provided. For example, first height adjustment member slidably received within the first vertical support member; a second height adjustment member slidably received within the second vertical support member; a third height adjustment member slidably received within the third vertical support member; and a fourth height adjustment member slidably received within may fourth vertical support member, may all be provided, wherein each of the first, second, third, and fourth height adjustment members may be independently adjusted to level the first and second rails.

These together with other aspects of the invention, along with the various features of novelty that can characterize the invention, are pointed out with particularity in the claims annexed hereto and form a part of this disclosure. For a better understanding of the invention, its operating advantages and the specific objects attained by its uses, the accompanying drawings and descriptive matter illustrate exemplary embodiments of the invention.

BRIEF DESCRIPTION OF THE DRAWINGS

FIG. 1 illustrates a perspective rear view of a first exemplary embodiment of the invention;

FIG. 2 illustrates a rear view of the first embodiment of FIG. 1;

Like reference numerals refer to like parts throughout the several views of the drawings.

DESCRIPTION OF THE INVENTION

The present invention is exemplified by the following embodiments. The exemplary embodiments described herein detail for illustrative purposes are subject to many variations and designs. It is understood that various omissions, substitutions of equivalents are contemplated as circumstances may suggest or render expedient, but the present invention is intended to cover the application or implementation without departing from the spirit or scope of the description herein. The system and method can be implemented in a wide variety of different configurations with a wide variety of different components.

In the following description, for purposes of explanation, numerous specific details are set forth in order to provide a thorough understanding of the present invention. It will be apparent, however, to one skilled in the art that the present invention may be practiced with obvious variations to these specific details.

Figure 12:
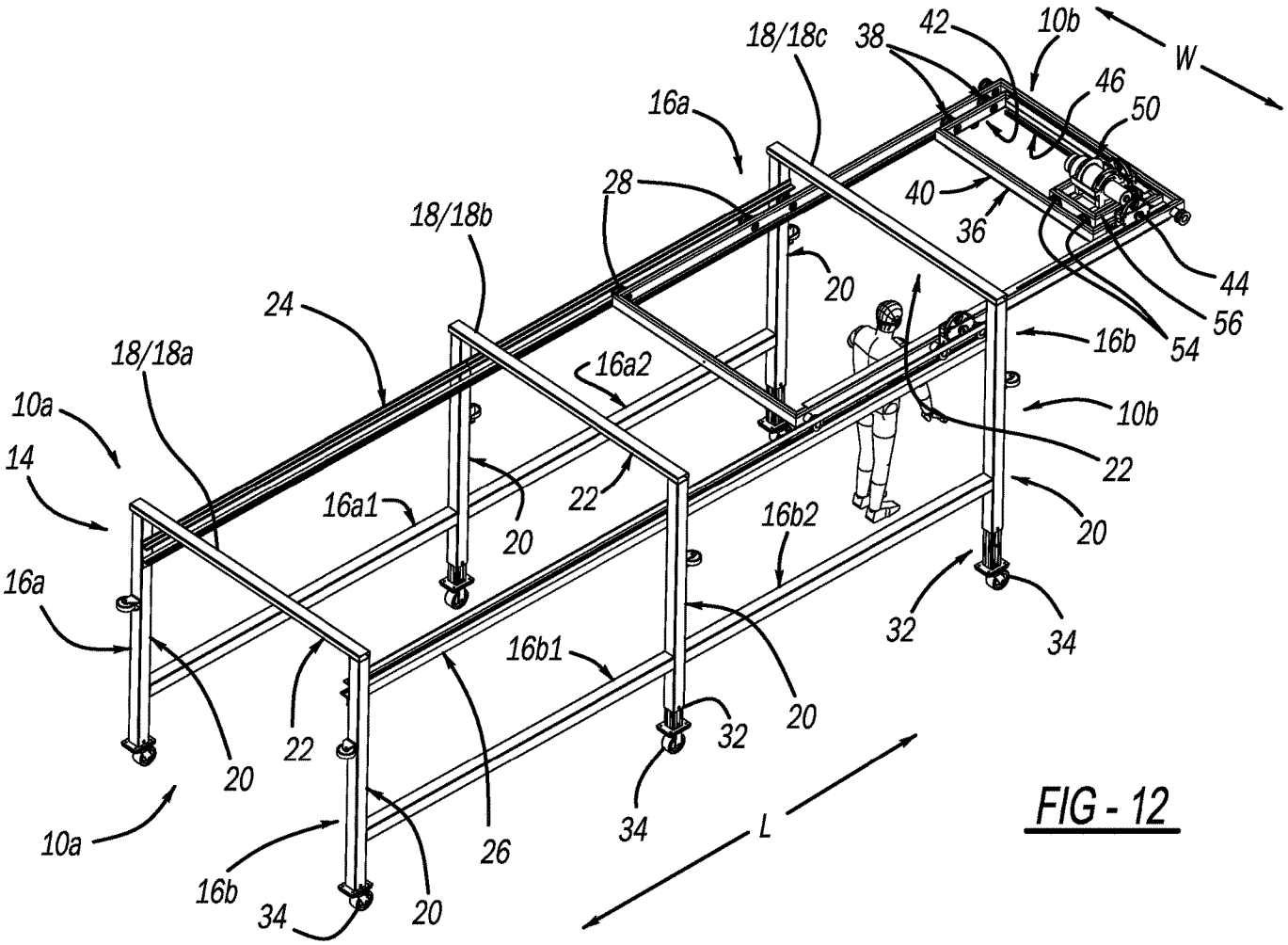
FIG. 12 illustrates a perspective view of a second embodiment of the present invention.
Figure 13:
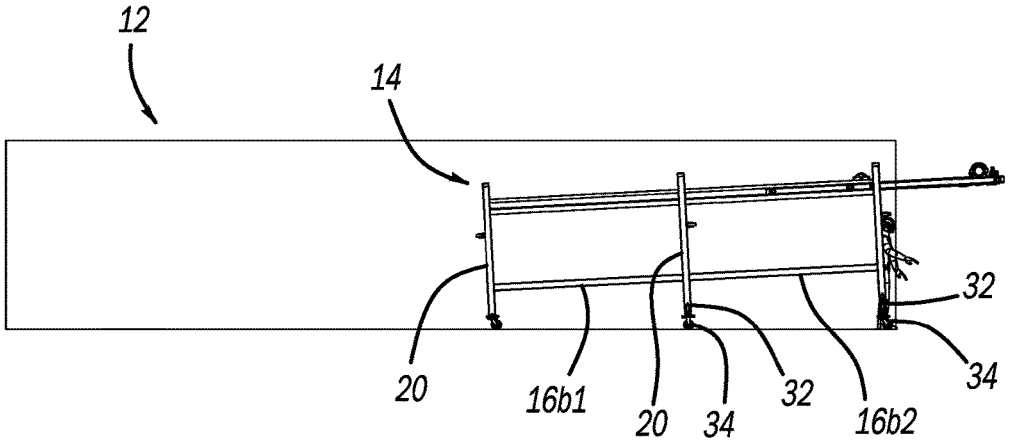
FIG. 13 illustrates a side view of the second embodiment of the present invention, wherein the second embodiment is leveled by the height adjusters.

With reference to FIGS. 12 and 13, one embodiment of a hoist and crane assembly 10 is shown. A frame assembly 14 extends longitudinally to fit within the length of an exemplary trailer 12, as shown in FIG. 13. A first longitudinal frame subassembly 16*a* extends from a first end 10*a* of the hoist and crane assembly 10 to a second end 10*b* of the assembly 10, and is fixed along a first side 14*a* of the frame assembly 14. A plurality of one or more longitudinal supports 16*a*1 and 16*a*2 forms subassembly 16*a*, wherein subassembly 16*a* extends from the first end 10*a* toward the second end 10*b* thereby providing a longitudinal support for the frame subassembly 14. A second longitudinal frame assembly 16*b* extends from a first end 10*a* of the hoist and crane assembly 10 to a second end 10*b* of the assembly 10, and is fixed along a second side 14*b* of the frame subassembly 14. A plurality of one or more longitudinal supports 16*b*1 and 16*b*2 forms subassembly 16*b*, wherein subassembly 16*b* extends from the first end 10*a* toward the second end 10*b* thereby providing a longitudinal support for the frame subassembly 14. As shown in a preferred embodiment, the longitudinal frame subassemblies 16*a* and 16*b* are generally oriented parallel to each other along the longitudinal sides of the subassembly 14.

A plurality of two or more cross-members or lateral members 18 (18*a*, 18*b*, and 18*c*) extend across the width W of the hoist and crane assembly 10, and are each fixed to longitudinal supports 16*a* and 16*b* respectively, thereby forming lateral supports for the frame subassembly 14. As shown in the Figures, a pair of vertical posts 20 are joined at opposite sides of each lateral member 18, and the vertical posts 20 are also orthogonally fixed to the longitudinal members 16*a* and 16*b*. A pair of vertical posts 20 are joined at opposite sides of each lateral member 18, thereby forming a u-channel support member 22 joined to both longitudinal support assemblies 16*a* and 16*b*. Each u-channel 22 formed by a respective lateral member 18 (18*a*, 18*b*, or 18*c*) joined to a pair of vertical posts 20, is equidistantly spaced longitudinally from one or more other so-formed u-channels 22.

A first rail member 24 is joined to plurality of two or more vertical posts 20 to extend along the first longitudinal support assembly 16*a*, thereby providing a rail for receipt of a plurality of rollers 28 as further explained below. A second rail member 26 is joined to plurality of two or more vertical posts 20 to extend along the second longitudinal support assembly 16*b*, thereby providing a rail for receipt of a second plurality of rollers 30 as further explained below.

Figure 3:
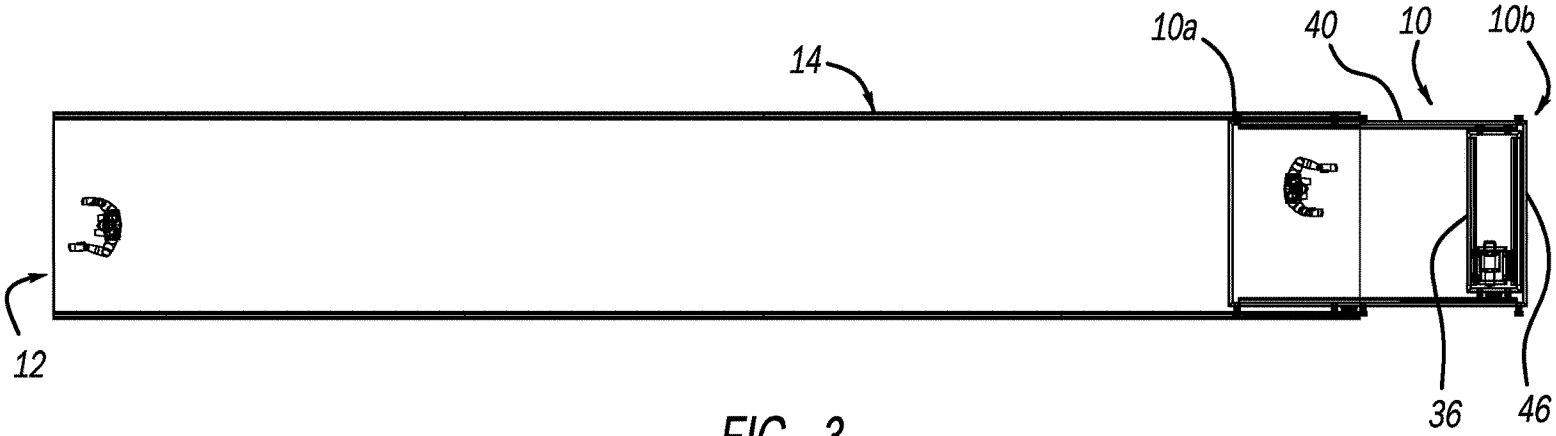
FIG. 3 illustrates a top view of the first embodiment of FIG. 1.
Figure 4:
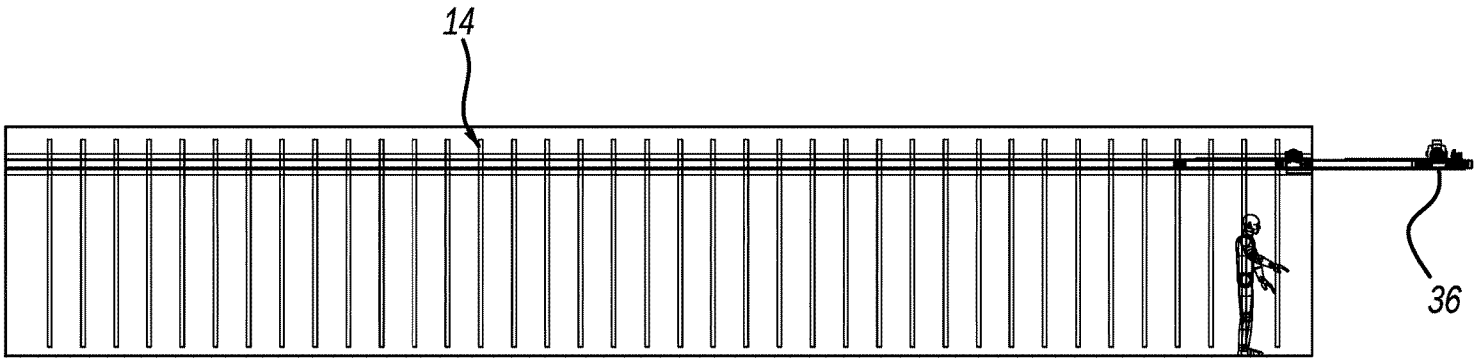
FIG. 4 illustrates a side view of the first embodiment of FIG. 1.
Figure 5:
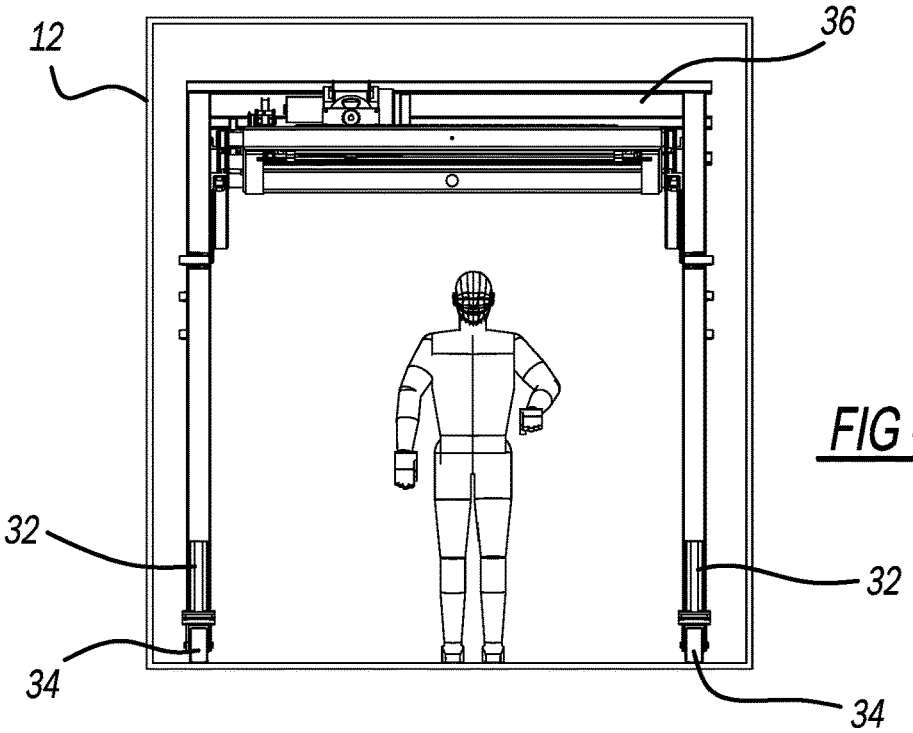
FIG. 5 illustrates a second embodiment in accordance with the present invention.
Figure 6:
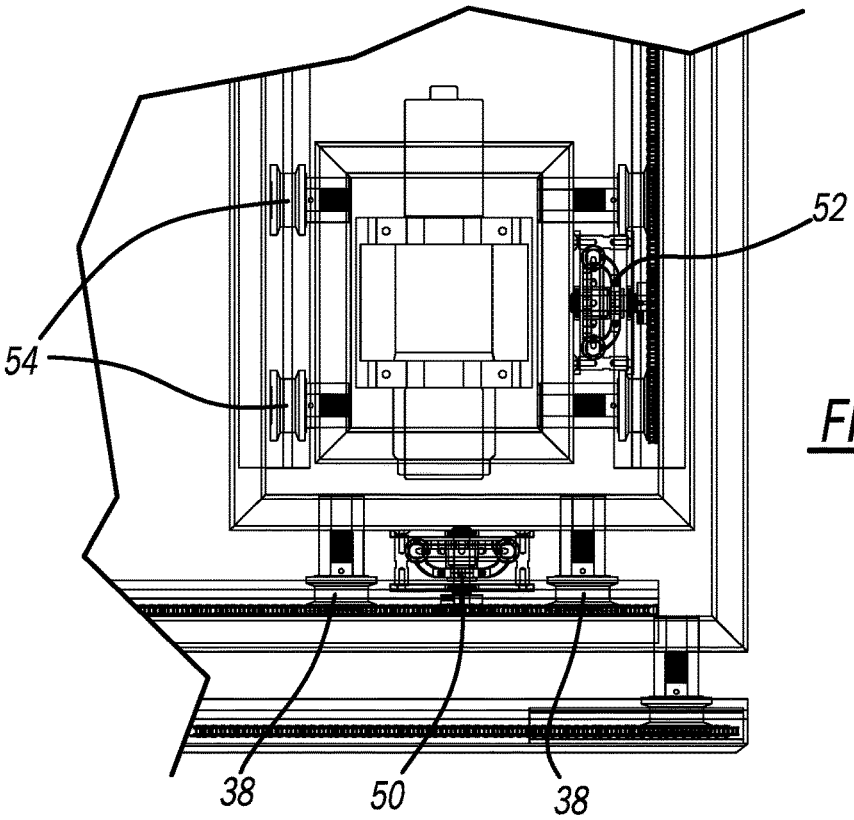
FIG. 6 illustrates an exploded view of the first and second drivers 50, 52 of FIG. 5.
Figure 7:
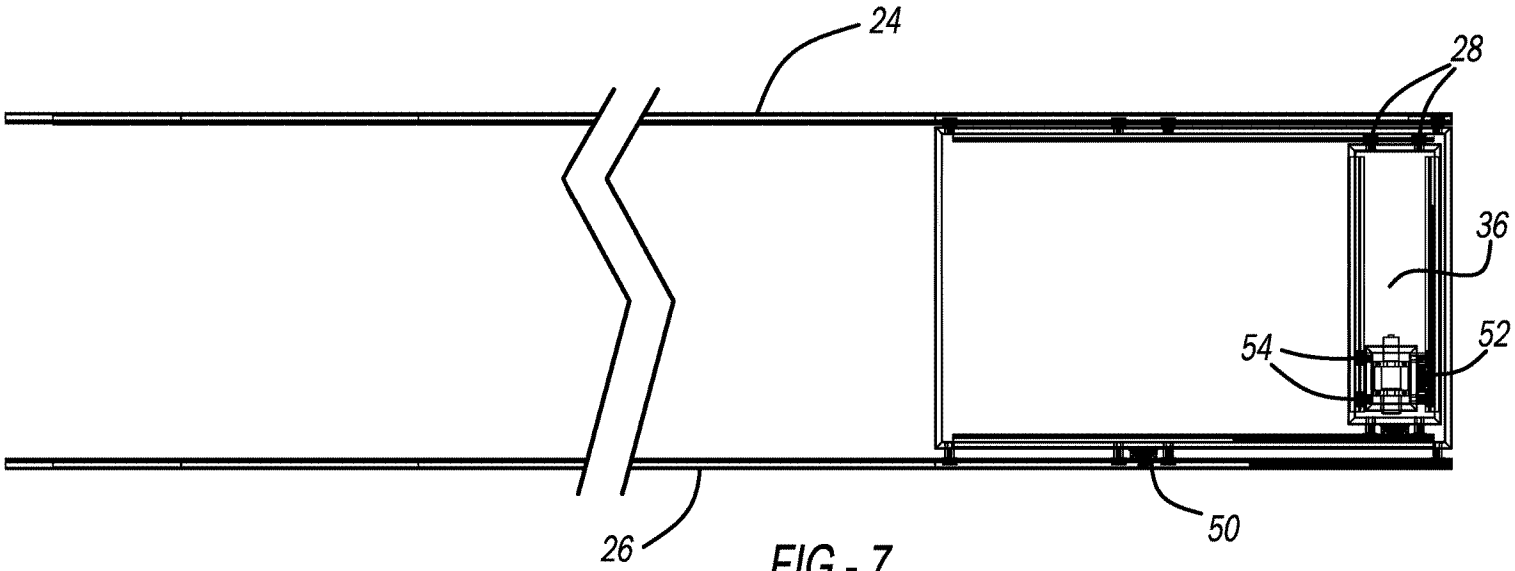
FIG. 7 illustrates a top view of a hoist assembly 36 in accordance with the present invention.
Figure 8:
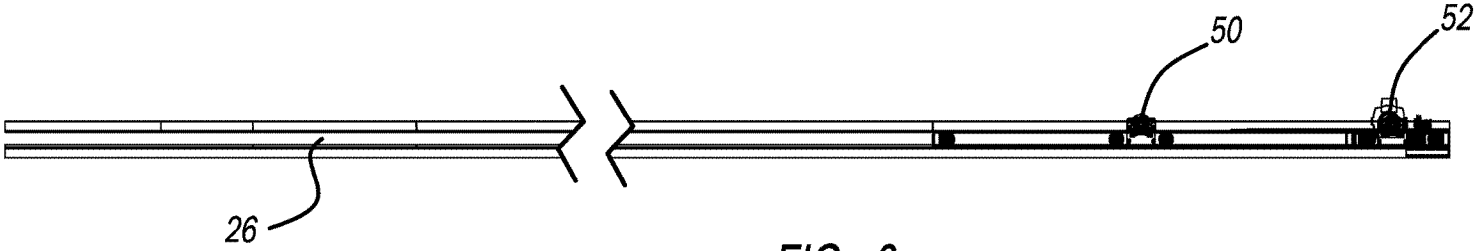
FIG. 8 schematically illustrates a side view of the hoist assembly of FIG. 7.
Figure 9:
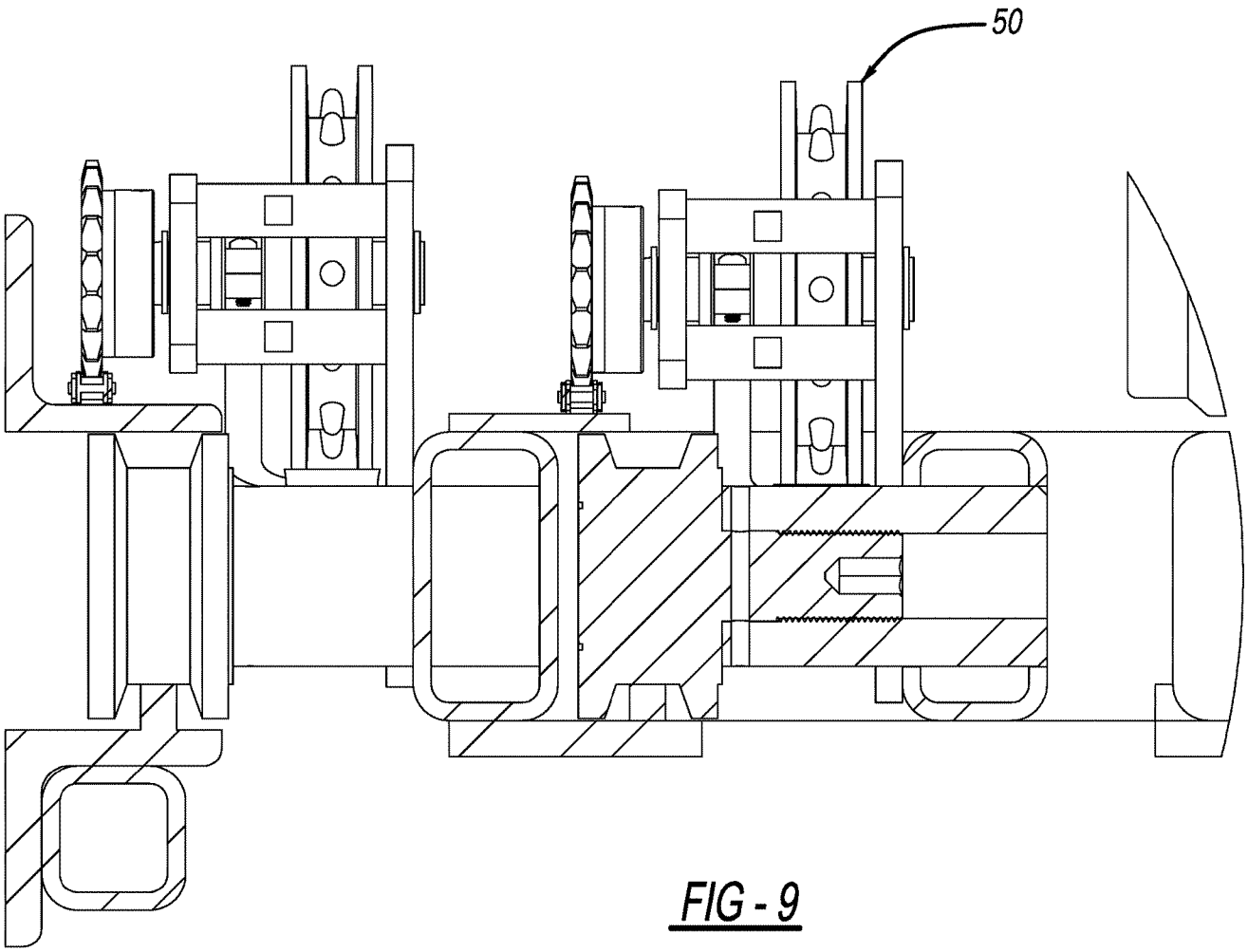
FIG. 9 schematically illustrates an exemplary driver 50.
Figure 10:
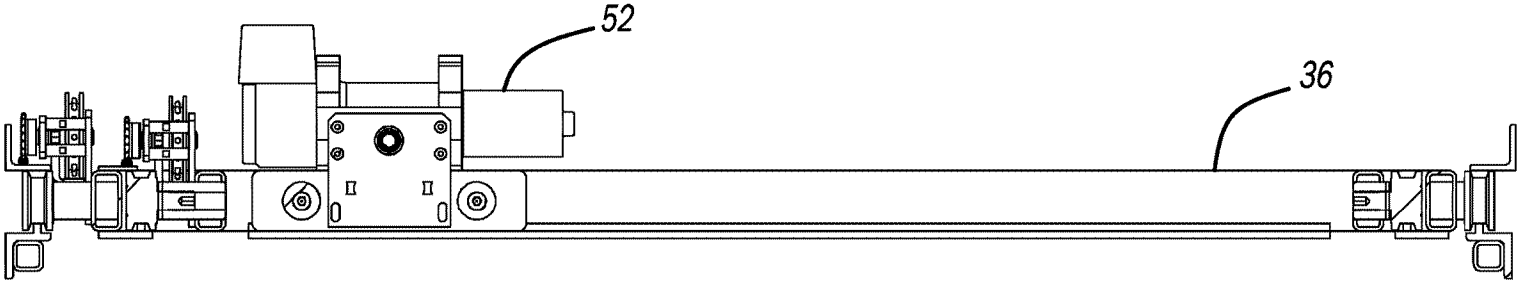
FIG. 10 schematically illustrates a rear view of the second driver of the present invention.
Figure 11:
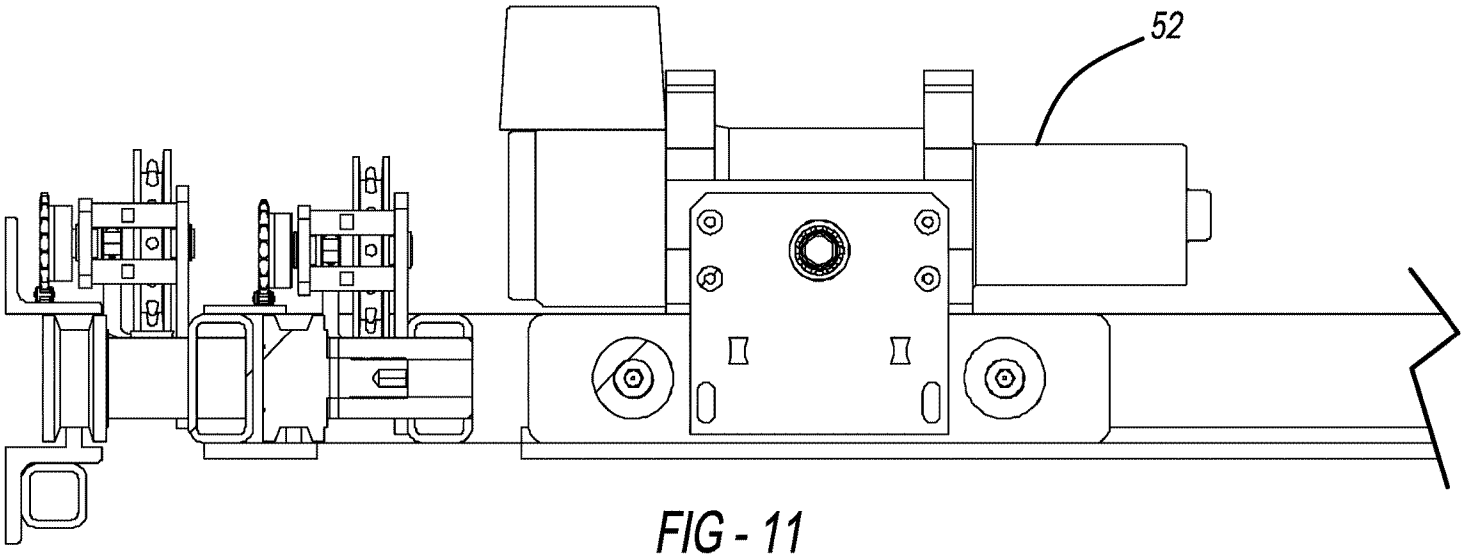
FIG. 11 schematically illustrates an exemplary driver 52 of the present invention.

If desired, each post 20 may form a sleeve that encases a height adjustment member 32, wherein each height adjustment member 32 is slidably engaged and removably fixed within the post 20. As shown in FIGS. 5, 12, and 13, for example, the height adjustment members 32 of each opposing post 20 may be locked at the same height. Each height adjustment member 32 may therefore be adjusted to essentially level the first rail 24 and second rail 26 so that the rail system is not operating on an incline. Yet further, if desired, a roller or wheel 34 may be rotatably fixed or otherwise fixed to each height adjustment member, thereby facilitating the free movement of the entire crane and hoist assembly 10 from the rear of the trailer 12 to the front of the trailer 12.

As shown throughout the FIGURES, a hoist assembly 36 is slidably housed within the rails 24 and 26, and is adapted to rearwardly extend from both first rail member 24 and second member 26. Stated another way, the hoist assembly is fixed to the rails 24 and 26, and rearwardly and movably extends from the rails 24, 26, to extend from the rear of a trailer 12, for example. A plurality of rollers 38 are fixed to the hoist assembly 36, wherein each roller 38 is rotatably engaged and seated within a respective rail 24 or 26, thereby facilitating movement of the hoist assembly 36 in and out from the frame assembly 14 or the trailer 12. A first transverse rail 40 extends across the hoist assembly 36, from a first longitudinal member 42 to a second longitudinal member 44 of the hoist assembly 36. A second transverse rail 46 is preferably coextensive and parallel to the first transverse rail 40, and also extends from the first longitudinal member 42 to the second longitudinal member 44. Each first and second transverse rail 40 and 46 provide lateral movement across the hoist and crane assembly 10. A first driver 50, such as a motor or hand chain (not shown) may be used to drive the hoist assembly longitudinally from and into the hoist and crane assembly 10, as known in the art, and as schematically shown in the drawings. A second driver 52, such as a motor or hand chain (not shown), may be used to drive the hoist assembly laterally along the first and second transverse rails 40 and 46. A second plurality of rollers 54 are fixed to a crane 56 and are rotatably engaged within the first and second transverse rails 40 and 46, thereby providing lateral movement across the hoist assembly 36.

In yet another embodiment shown in FIGS. 1-11, the first rail member 24 may alternatively be secured to a first side 12*a* of the trailer 12 and the second rail member 26 may alternatively be secured to a second side 12*b* of the trailer 12. Each rail 24 and 26 extends from the rear 12*c* of the trailer 12 to the front 12*d* of the trailer 12, thereby obviating the need for a frame assembly 14. The hoist assembly 36 may be connected to the rails 24 and 26 as described above, and the crane 56 may be moved longitudinally and laterally across the interior of the trailer 12, as described above.

The foregoing descriptions of specific embodiments of the present invention have been presented for purposes of illustration and description. They are not intended to be exhaustive or to limit the invention to the precise embodiments disclosed, and many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is understood that various omissions, substitutions of equivalents are contemplated as circumstance may suggest or render expedient, but is intended to cover the application or implementation without departing from the spirit or scope of the claims of the present invention.

Although only particular exemplary embodiments of the invention have been disclosed for illustrative purposes, it will be recognized to those skilled in the art that variations or modifications of the disclosed invention, including the rearrangement in the configurations of the parts, changes in sizes and dimensions, and variances in terms of shape, for example, may be possible. Accordingly, the invention is intended to embrace all such alternatives, modifications and variations as may fall within the spirit and scope of the present invention.

The foregoing descriptions of specific embodiments of the present invention have been presented for purposes of illustration and description. They are not intended to be exhaustive or to limit the invention to the precise embodiments disclosed, and many modifications and variations are possible in light of the above teaching, within the limits of the appended claims. It is understood that various omissions, and/or substitutions of equivalents are contemplated as circumstance may suggest or render expedient, without departing from the spirit or scope of the claims of the present invention.

What is claimed is:

1. A truck hoist and crane assembly comprising:

a first rail and a second rail each vertically supported, and each longitudinally extending within said hoist and crane assembly, said second rail oriented substantially parallel to said first rail;

a third rail slidably engaged to said first rail and a fourth rail slidably engaged to said second rail, thereby facilitating concurrent longitudinal movement of said third and fourth rails to extend from a rear of the hoist and crane assembly, said third rail and said fourth rail juxtaposed to and parallel to said first and second rails, respectively;

a fifth rail angularly fixed to said third rail and said fourth rail, and, a sixth rail angularly fixed to said third rail and said fourth rail, said fifth rail substantially parallel to said sixth rail; and a hoist operably fixed to said fifth and sixth rails, said hoist movable from said third rail to said fourth rail, and said hoist extendable and retractable from said first and second rails, wherein said hoist is operable in both a lateral and longitudinal motion, and, wherein said third rail and said fourth rail are adapted to extend from said first and second rails, respectively.

2. The assembly of claim 1, further comprising:

a first driver for laterally moving said hoist from said third rail to said fourth rail.

3. The assembly of claim 2, further comprising:

a second driver for longitudinally moving said hoist to extend from or retract towards said first and second rails.

4. The assembly of claim 1 further comprising:

a first vertical support member and a second vertical support member longitudinally displaced from said first vertical support member, each of said first and second vertical support members fixed to said first rail; and a third vertical support member and a fourth vertical support member longitudinally displaced from said third vertical support member, each of said third and fourth vertical support members fixed to said second rail.

5. The assembly of claim 4 further comprising:

a first longitudinal support member fixed to said first and second vertical support members;

and, a second longitudinal support member fixed to said third and fourth vertical support members.

6. The assembly of claim 5 further comprising:

a first lateral support member fixed to said first vertical support member and to said third vertical support member, said first lateral support member substantially orthogonally oriented to said first and second longitudinal members; and a second lateral support member fixed to said second vertical support member and to said fourth vertical support member, said second lateral support member substantially orthogonally oriented to said second and fourth longitudinal members.

7. The assembly of claim 4 further comprising:

a first height adjustment member slidably received within said first vertical support member;

a second height adjustment member slidably received within said second vertical support member;

a third height adjustment member slidably received within said third vertical support member; and a fourth height adjustment member slidably received within said fourth vertical support member, wherein each of said first, second, third, and fourth height adjustment members may be independently adjusted to level said first and second rails.

* * * * *